US008597045B2

(12) United States Patent
Zhu et al.

(10) Patent No.: US 8,597,045 B2
(45) Date of Patent: Dec. 3, 2013

(54) TRANSCEIVER CONNECTOR HAVING IMPROVED COLLAR CLIP

(75) Inventors: Jian-Jun Zhu, Kunshan (CN); Qing-Man Zhu, Kunshan (CN); Chien-Chiung Wang, New Taipei (CN)

(73) Assignee: Hon Hai Preicision Industry Co., Ltd., New Taipei (TW)

( * ) Notice: Subject to any disclaimer, the term of this patent is extended or adjusted under 35 U.S.C. 154(b) by 73 days.

(21) Appl. No.: 13/432,285

(22) Filed: Mar. 28, 2012

(65) Prior Publication Data

US 2012/0252256 A1 Oct. 4, 2012

(51) Int. Cl.
*H01R 13/627* (2006.01)

(52) U.S. Cl.
USPC ..... 439/357; 439/607.01

(58) Field of Classification Search
USPC ..... 439/357, 607.01; 385/89, 92
See application file for complete search history.

(56) References Cited

U.S. PATENT DOCUMENTS 6,776,623 B1 * 8/2004 Yunker et al. ..... 439/71
7,287,916 B2 * 10/2007 Mizue ..... 385/92
7,351,090 B1 * 4/2008 Moore ..... 439/372
7,566,246 B2 * 7/2009 Moore et al. ..... 439/607.01
7,802,929 B2 * 9/2010 Moore et al. ..... 385/92
7,898,808 B2 * 3/2011 Joiner et al. ..... 361/707
7,955,003 B2 * 6/2011 Teo et al. ..... 385/92
7,957,159 B2 * 6/2011 Wu ..... 361/818
8,064,207 B2 * 11/2011 Wu ..... 361/747
2004/0037517 A1 * 2/2004 Dair et al. ..... 385/92
2006/0215968 A1 * 9/2006 Kayner et al. ..... 385/89
2007/0117458 A1 * 5/2007 Winker et al. ..... 439/607

* cited by examiner

*Primary Examiner* — Amy Cohen Johnson
*Assistant Examiner* — Vladimir Imas
(74) *Attorney, Agent, or Firm* — Ming Chieh Chang; Wei Te Chung

(57) ABSTRACT

A transceiver connector (100) includes a housing (1) having a number of faces including a primary face (10) and a pair of side faces (13) and a collar clip (2). The collar clip includes a base at least partially surrounding the plurality of faces of the housing. The primary face defines at least one vertically extending locking recess (104) having a stepped portion (1041). The collar clip includes a base (20) at least partially surrounding the number of faces of the housing. The base includes at least one locking beam (204) inserted into the corresponding locking recess of the housing along a first direction and having a click portion (2041) engaging with the stepped portion of the housing along a second direction perpendicular to the first direction.

20 Claims, 4 Drawing Sheets

TRANSCEIVER CONNECTOR HAVING IMPROVED COLLAR CLIP

BACKGROUND OF THE INVENTION

1. Field of the Invention

The present invention relates to a transceiver connector, and more particularly to a SFP (Small Form-Factor Pluggable) transceiver connector having a collar clip attached to a housing reliably.

2. Description of Related Art

U.S. Pat. No. 7,566,246 issued to Moore et al. on Jul. 28, 2009 discloses an SFP plug connector comprising a shell defining a plurality of substantially circular posts positioned in a row along at least one side of the shell, a circuit board at least partially positioned within the shell, an opto-electrical module electrically connected to the circuit board, and a collar clip. The collar clip comprises a body partially encircling the shell, and a plurality of fingers or extended elements located on at least one edge of the body. A substantially circular cavity is provided between two adjacent extended elements. The collar clip also has respective inwardly bent locking flanges at two ends of the body. The shell defines a pair of indentations. Each locking flange is inserted into the indentation along a bottom-to-top direction.

The prior art collar clip may not be fastened to the shell firmly.

A transceiver connector having an improved collar clip is desired.

SUMMARY OF THE INVENTION

Accordingly, an object of the present invention is to provide a transceiver connector having a collar clip latching with a housing reliably through two perpendicular directions.

In order to achieve the object set forth, a transceiver connector includes a housing having a number of faces including a primary face and a pair of side faces and a collar clip. The collar clip includes a base at least partially surrounding the plurality of faces of the housing. The primary face defines at least one vertically extending locking recess having a stepped portion. The collar clip includes a base at least partially surrounding the number of faces of the housing. The base includes at least one locking beam inserted into the corresponding locking recess of the housing along a first direction and having a click portion engaging with the stepped portion of the housing along a second direction perpendicular to the first direction.

Even if the base of the collar clip is encountered an expelling force, the engagement between locking beam and the locking recess along the first direction and the engagement between the click portions and the stepped portions along the second direction perpendicular to the first direction would reliably secure the collar clip onto the housing.

Other objects, advantages and novel features of the invention will become more apparent from the following detailed description when taken in conjunction with the accompanying drawings.

DETAILED DESCRIPTION OF THE PREFERRED EMBODIMENT

Figure 1:
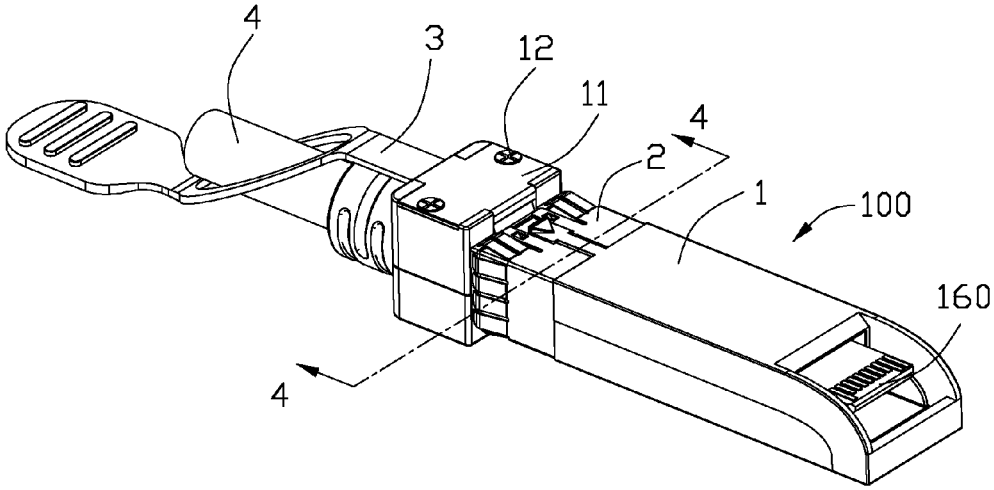
FIG. 1 is an assembled perspective view showing a transceiver connector in accordance with the present invention.
Figure 2:
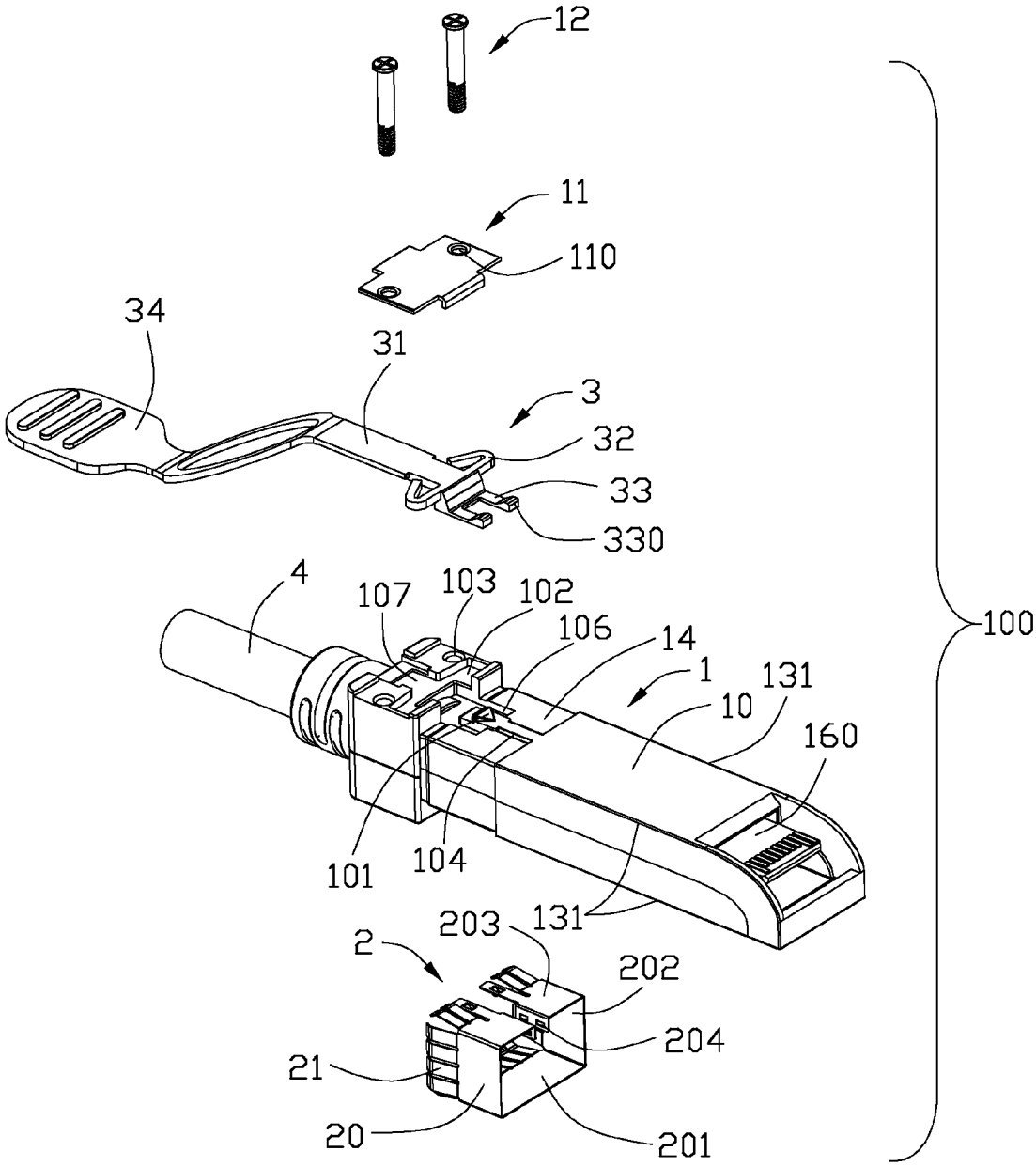
FIG. 2 is an exploded perspective view showing the transceiver connector as shown in FIG. 1.
Figure 3:
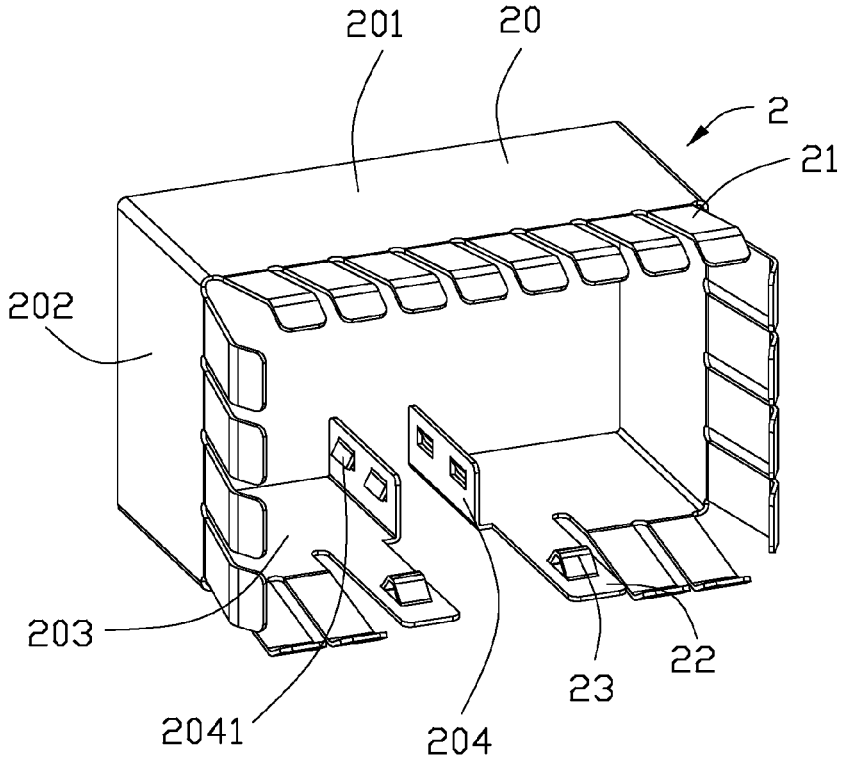
FIG. 3 is a perspective view showing the collar clip.

Reference will now be made in detail to the preferred embodiment of the present invention.

Referring to FIGS. 1-4, a transceiver connector 100 in accordance with the present invention includes a housing 1, a circuit board 160 received in the housing 1, a collar clip 2 attached to the housing 1, and a releasing mechanism 3 assembled to the housing 1, a cover 11 and a pair of screws 12 mounted on the housing 1, and a cable 4 connected to the housing 1.

Figure 4:
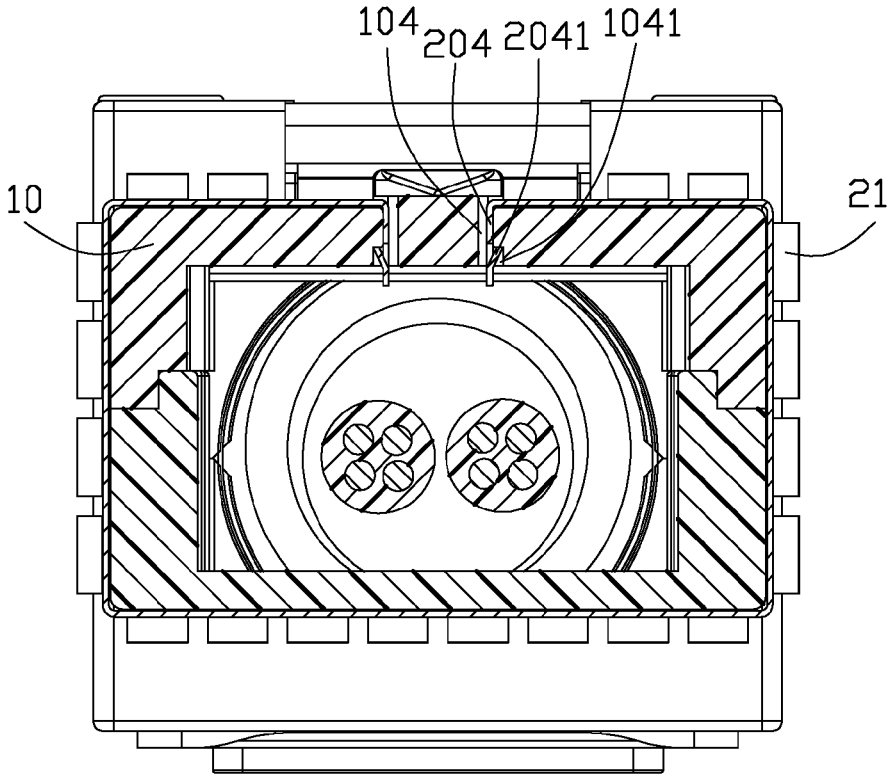
FIG. 4 is cross-sectional view showing the transceiver connector, taken along line 4-4 of FIG. 1.

The housing 1 comprises a primary face 10 and a pair of side faces 13. The housing 1 includes a latching protrusion 101 projecting from the primary face 10, a receiving recess 14 defined around the housing 1, a pair of accommodating recesses 106 defined at opposite sides of the latching protrusion 101, and a pair of vertically extending locking recesses 104 in front of the accommodating recesses 106. Referring to FIG. 4, each locking recess 104 is formed with a stepped portion 1041. The primary face 10 of the housing 1 includes a concave portion 107, a pair of ear recesses 102 communicating with the concave portion 107, and a pair of inserting holes 103 extending along an up-to-bottom direction.

The collar clip 2 is bent from a punched metal sheet. The collar clip 2 includes a base 20 having a primary portion 201, a pair of periphery portions 202 extending perpendicularly from opposite ends of the primary portion 201 and a pair of connecting portions 203 respectively connected with the periphery portions 202. Each connecting portion 203 has a locking beam 204 bent perpendicularly from the connecting portion 203 toward the primary portion 201. Each locking beam 204 is formed with a plurality of click portions 2041. Each connecting portion 203 includes a lifting beam 22 having a cooperating protrusion 23 projecting toward the base portion 201. The collar clip 2 further has a plurality of spring fingers 21 extending obliquely from the base 20.

The releasing mechanism 3 comprises a body portion 31, a pair of releasing beams 33 extending forwardly from the body portion 31, a pair of substantially compressible U-shaped resilient portions 32 formed at opposite sides of the body portion 31, and a puller 34 formed behind the body portion 31. Each releasing beam 33 is formed with an upwardly projecting releasing protrusion 330.

The cover 11 defines a pair of through holes 110.

Referring to FIGS. 1-4, in assembling of the transceiver connector 100, the releasing mechanism 3 is mounted on the housing 1, with the body portion 31 received in the concave portion 107, the pair of resilient portions 32 compressible in the ear recesses 102, and the pair of releasing beams 33 accommodated in the accommodating recesses 106. The cover 11 is attached to the housing 1, with the pair of screws 12 inserting through the though holes 110 of the cover 11 and the inserting holes 103 of the housing 1 to secure the cover 11 onto the housing 1.

The collar clip 2 is attached to the housing 1, with base 20 accommodated in the receiving recess 14 for at least partially surrounding the housing 1. The pair of locking beams 204 are inserted in the concave recesses 104 along a vertical direction, with the click portions 2041 engaged with the stepped portions 1041 along a transverse direction. The plurality of spring fingers 21 resist against the mating receptacle for anti-EMI (Electro Magnetic Interference) purpose.

In a latched position, the latching protrusion 101 is engaged with a latching hole (not shown) of a latching tab (not shown) of a mating receptacle (not shown).

In extraction of the transceiver connector 1 from the mating receptacle (not shown), when the puller 34 is pulled rearwardly, the releasing protrusions 330 move rearwardly to lift the cooperating protrusions 23. The lifting beams 22 tilt upwardly to expel the latching tab of the mating receptacle away from the latching protrusion 101. The releasing mechanism 3 is disposed in a released position.

The locking beam 204 has an inner side facing the corresponding periphery portion 202 and an outer side opposite to the inner side. The click portions 2041 are formed at an inner side of the locking beam 204 in this embodiment, and could be optionally formed at the outer side of the locking beam 204. The click portions 2041 of one locking beam 204 and the click portions 2041 of another locking beam 204 could be formed symmetrically with each other, or formed in other unsymmetrical manner, e.g. offset manner.

Even if the movement of the releasing protrusions 330 generate an upward force to the connecting portions 203 of the collar clip 2, the engagement between locking beam 204 and the locking recess 104 along the vertical direction and the engagement between the click portions 2041 and the stepped portions 1041 along the transverse direction would reliably secure the collar clip 2 onto the housing 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A transceiver connector comprising:

a housing having a plurality of faces including a primary face and a pair of side faces, said primary face defining at least one vertically extending locking recess having a stepped portion; and a collar clip including a base at least partially surrounding the plurality of faces of the housing, the base comprising at least one locking beam inserted into the corresponding locking recess of the housing along a first direction and having at least a click portion engaging with the stepped portion of the housing along a second direction perpendicular to the first direction.

2. The transceiver connector as claimed in claim 1, wherein there are a pair of locking recesses defined on the primary face of the housing and there are a pair of locking beams formed on the base.

3. The transceiver connector as claimed in claim 2, wherein said collar clip is bent from a punched metal sheet, said base including a primary portion, a pair of periphery portions extending perpendicularly from opposite ends of the primary portion and a pair of connecting portions respectively connected with the periphery portions, each locking beam being bent perpendicularly from the corresponding connecting portion toward the primary portion.

4. The transceiver connector as claimed in claim 3, wherein there are a plurality of click portions formed on each locking beam.

5. The transceiver connector as claimed in claim 4, wherein each locking beam has an inner side facing the corresponding periphery portion and an outer side opposite to the inner side, the plurality of click portions being formed at the inner side of the locking beam.

6. The transceiver connector as claimed in claim 4, wherein each locking beam has an inner side facing the corresponding periphery portion and an outer side opposite to the inner side, the plurality of click portions being formed at the outer side of the locking beam.

7. The transceiver connector as claimed in claim 4, wherein said plurality of click portions on one locking beam are symmetrically formed with the plurality of click portions on another locking beam.

8. The transceiver connector as claimed in claim 4, wherein said plurality of click portions on one locking beam are offset from the plurality of click portions on another locking beam.

9. The transceiver connector as claimed in claim 2, wherein said collar clip further has a plurality of spring fingers extending obliquely from the base for resisting against a mating receptacle.

10. The transceiver connector as claimed in claim 2, wherein said housing has a receiving recess defined therearound for accommodating the base of the collar clip, a depth of the receiving recess being at least not less than a thickness of the base of the collar clip.

11. A transceiver connector for use within a cage having a deflectable locking tab with a locking hole therein, comprising:

a housing defining a mating port in a front portion to forwardly communicate with an exterior in a front-to-back direction, and a locking port in a rear portion to communicate with the exterior in a vertical direction perpendicular to said front-to-back direction;

a cable extending rearward from a rear end of the housing opposite to the mating port;

a latching protrusion formed on the locking port for locking into the locking hole in the locking tab of the cage;

a one-piece collar clip attached unto the locking port around the latching protrusion, said collar clip equipped with a plurality of curved spring fingers arranged in generally a circumferential manner with regard to the housing for circumferentially contacting the cage and a pair of deflectable lifting arms intimately located by two sides of the latching protrusion in the transverse direction perpendicular to both said front-to-back direction and said vertical direction, each of said lifting arms defining a cooperating protrusion; and a releasing mechanism attached to the housing and back and forth moveable relative to the housing in the front-to-back direction, said releasing mechanism including a pair of releasing beams located between the pair of lifting arms and the housing in the vertical direction; wherein via rearward movement of the releasing mechanism, the releasing beams actuate respectively the pair of lifting arms, due to the corresponding cooperating protrusions, to be deflected outwardly in the vertical direction for outwardly deflecting the locking tab of the cage to unlock the latching protrusion from the locking hole of the cage.

12. The transceiver connector as claimed in claim 11, wherein the collar clip defines a pair of locking beams receiving in a pair of corresponding locking recesses in the housing for attaching the collar clip to the housing.

13. The transceiver connector as claimed in claim 12, wherein said pair of locking beams are located adjacent to the pair of lifting arms, respectively, in an offset manner in the front-to-back direction.

14. The transceiver connector as claimed in claim 12, wherein each of the pair of locking beams is equipped with a clicking portion abutting against a step in the corresponding locking recess.

15. The transceiver connector as claimed in claim 11, wherein each of the releasing arms is equipped with a projecting protrusion to contact the corresponding cooperating protrusion.

16. The transceiver connector as claimed in claim 11, wherein the releasing mechanism defines a through hole through which the cable extends rearwardly.

17. The transceiver connector as claimed in claim 11, wherein both said spring fingers and lifting arms extend rearwardly in a cantilevered manner.

18. The transceiver connector as claimed in claim 11, wherein said lifting arm is flat in a relaxed manner while curvedly deflected when actuated by the corresponding releasing beam.

19. A transceiver connector for use within a cage having a deflectable locking tab with a locking hole therein, comprising:

a housing defining a mating port in a front portion to forwardly communicate with an exterior in a front-to-back direction, and a locking port in a rear portion to communicate with the exterior in a vertical direction perpendicular to said front-to-back direction;

a cable extending rearward from a rear end of the housing opposite to the mating port;

a latching protrusion formed on the locking port for locking into the locking hole in the locking tab of the cage;

a collar clip attached unto the locking port around the latching protrusion, said collar clip equipped with a plurality of curved spring fingers arranged in generally a circumferential manner with regard to the housing for circumferentially contacting the cage and a pair of deflectable lifting arms intimately located by two sides of the latching protrusion in the transverse direction perpendicular to both said front-to-back direction and said vertical direction, each of said lifting arms defining a cooperating protrusion, and further with a pair of locking beams adjacent to the pair of corresponding lifting arms while in an offset manner in the front-to-back direction for respective reception within a pair of corresponding locking recesses; and a releasing mechanism attached to the housing and back and forth moveable relative to the housing in the front-to-back direction; wherein due to the corresponding cooperating protrusions, in response to rearward movement of the releasing mechanism the lifting arms are deflected outwardly in the vertical direction for outwardly deflecting the locking tab of the cage to unlock the latching protrusion from the locking hole of the cage.

20. The transceiver connector as claimed in claim 19, wherein each of the locking beams is equipped with a clicking portion abutting against a step in the corresponding locking recess.

* * * * *